United States Patent [19]

Moritz et al.

[11] Patent Number: 4,753,542

[45] Date of Patent: Jun. 28, 1988

[54] MALFUNCTION PREVENTING ARRANGEMENT OF RIBBON & CORRECTION TAPE

[75] Inventors: Manfred Moritz, Nuremberg; Wilfried Rettke, Altdorf, both of Fed. Rep. of Germany

[73] Assignee: Ta Triumph-Adler Aktiengesellschaft, Nuremberg, Fed. Rep. of Germany

[21] Appl. No.: 2,746

[22] Filed: Jan. 12, 1987

[30] Foreign Application Priority Data

Jan. 20, 1986 [DE] Fed. Rep. of Germany ..... 3601484

[51] Int. Cl.[4] ..... B41J 29/36; B41J 29/367

[52] U.S. Cl. ..... 400/697; 400/211

[58] Field of Search ..... 400/697, 697.1, 211-213

[56] References Cited

U.S. PATENT DOCUMENTS

| | | | |
|---|---|---|---|
| 3,997,046 | 12/1976 | Wolowitz | 400/697.1 |
| 4,071,134 | 1/1978 | Humphrey | 400/697.1 |
| 4,425,046 | 1/1984 | Van Horne et al. | 400/212 |
| 4,440,514 | 4/1984 | Keiter et al. | 400/697.1 |

FOREIGN PATENT DOCUMENTS

| | | | |
|---|---|---|---|
| 2853329 | 6/1979 | Fed. Rep. of Germany . | |
| 2909231 | 9/1980 | Fed. Rep. of Germany . | |
| 2850711 | 7/1985 | Fed. Rep. of Germany . | |
| 96981 | 6/1984 | Japan | 400/697 |

*Primary Examiner*—Edgar S. Burr
*Assistant Examiner*—James Lisehora
*Attorney, Agent, or Firm*—Browdy and Neimark

[57] ABSTRACT

A ribbon and correction tape are separately mounted on a typewriter for movement in closely spaced parallel planes from a position below a line of impact along a line of print to an elevated position opposite said line of print. To minimize interference and malfunctions during relative movement of the ribbon and tape during elevating movement of one, the ribbon and tape are supported at an acute angle to one another, thereby to move in scissor fashion relative to the other.

3 Claims, 1 Drawing Sheet

MALFUNCTION PREVENTING ARRANGEMENT OF RIBBON & CORRECTION TAPE

BACKGROUND OF THE INVENTION

1. Field of the Invention

This invention relates to typewriters having an inked ribbon and a correction tape wherein lengths thereof are guided through closely adjacent parallel planes to present the ribbon or tape in the line of impact of a printing element, with the plane of the correction tape between the plane of the inked ribbon and a plane including a printing line along a platen.

2. Description of Related Art

Especially in type wheel typewriters, the distance between the types on the type wheel spokes and the platen should be as small as possible to prevent the spokes from deflecting too much. But this small distance means that but little space is available for an inked ribbon and a correction tape. This is cause for trouble. The trouble may consist in that the type wheel spokes catch in either the ribbon or the tape. But it also happens that the long edges of both ribbon and tape gate on top of each other during the raising and lowering motion. All of these malfunctions prevent proper operation of the typewriter. It has already been proposed to arrange the ribbon and the correcting tape one above the other in a vertical plane. But this has the disadvantage that, in order to make corrections, the inked ribbon has to be raised also, and that by a very long angular travel. All of these solutions are not entirely satisfactory.

SUMMARY OF THE INVENTION

In accordance with the invention, the ink ribbon and correction tape are guided in closely spaced planes parallel to a printing plane and are supported at acute angles to one another whereby relative movement between them during selected elevating movements is scissor-like, minimizing contact interference and consequent malfunctions. Due to the fact that the ribbon and correction tape always are at an acute angle relative to each other in both positions and move relative to one another in the manner of scissors, their long edges can no longer interfere with each other. Consequently, the troubles caused thereby in the operation of the typewriter can no longer occur. The arrangement of ribbon and correction tape relative to each other must be such that in its normal position the correction tape is not in the line of impact opposite a printing line of the platen, yet is in the line of impact when elevated to its raised position. The device thus functions well also with a relatively short raising motion for the correction tape.

An object of the invention is to provide a ribbon and correction tape arrangement which with certainty and without causing additional costs minimize interference between the relative motion of the ribbon and correction tape to prevent malfunctioning.

Another object of the invention is in the provision of an arrangement of inked ribbon and correction tape such that relative movement therebetween occurs in scissor-like fashion.

Other objects, features and advantages of the present invention will become better known to those skilled in the art from a reading of the following detailed description when taken in conjunction with the accompanying drawing wherein like reference numerals designate like or corresponding elements throughout the several views thereof and wherein:

DESCRIPTION OF PREFERRED EMBODIMENT

Figure 1:
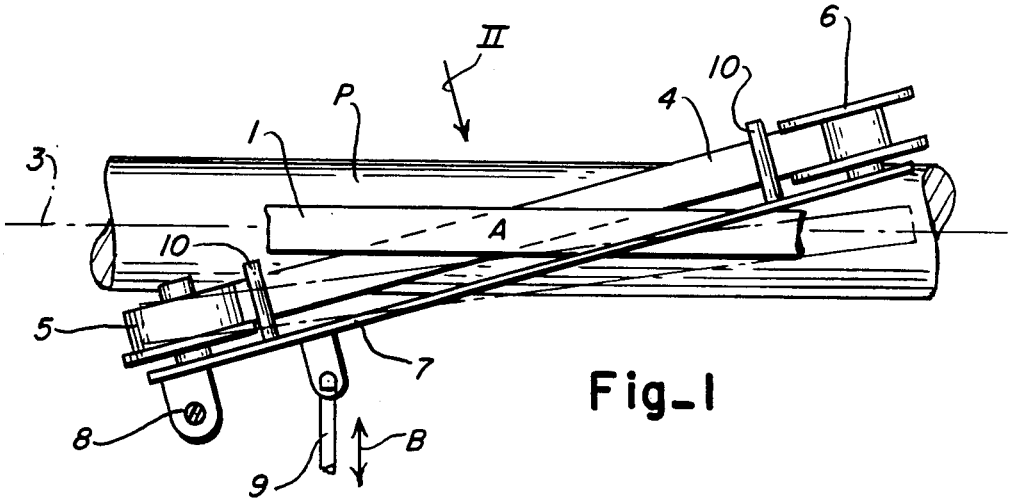
FIG. 1 is an elevational view showing the arrangement of ribbon and correction tape in typing direction.

Referring now to the drawing, there is shown in FIG. 1 an inked ribbon, which ribbon 1 may be provided, e.g. in a ribbon cassette 2 designed to guide a length of ribbon external to the cassette 2 in a plane which is parallel to a printing plane tangent to a platen P including a printing line 3, and is perpendicular to a line A of impact opposite the printing line 3. As is known, the ribbon cassette 2 may rest on a raisable and lowerable holder, or on a pivotable cassette seat (not shown) for the purpose of presenting the inked ribbon 1 at the printing line 3.

Figure 2:
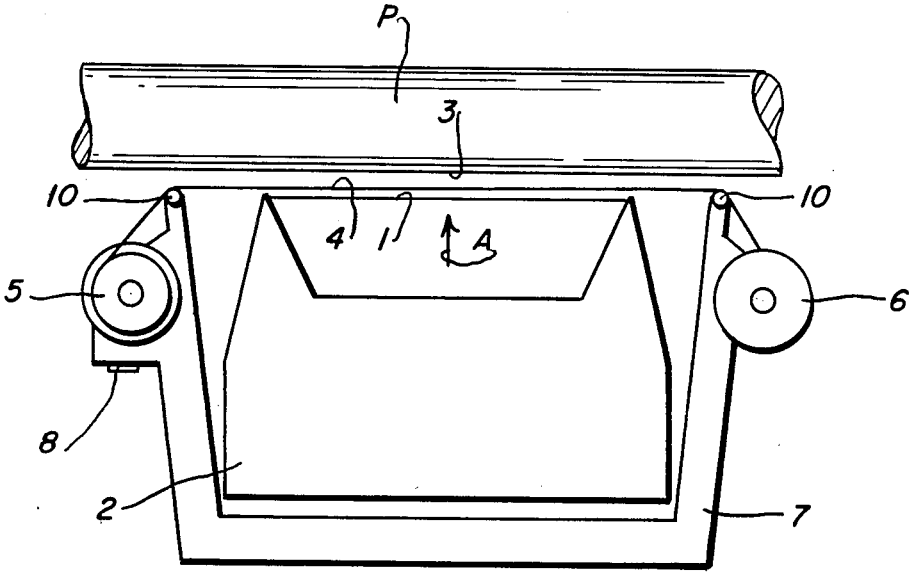
FIG. 2 is a top view taken in the direction of arrow II in FIG. 1 in smaller scale.

Two spools 5 and 6 from which correction tape 4 is drawn off and taken up are disposed on a correction tape carrier 7. As shown in FIG. 1, the correction tape carrier 7 is mounted so as to be pivotable about a pivot pin 8 to the left of and parallel to the line of impact A and below the printing line 3. The pivoting motion may be accomplished, e.g. by a rod 9 movable in the direction of the double arrow B by means of a magnet or cam drive (not shown). As seen in FIG. 2, the correction tape 4 is guided by the two deflectors 10 as close to the platen 3 as possible and parallel to the printing plane.

As shown in FIG. 1, the angle of the correction tape 4 relative to the wheel ribbon 1 is approximately 8° in normal position and approximately 15° in the elevated position. With this arrangement, a short lifting motion suffices for the correction tape 4. As shown in FIG. 1, to better illustrate the arrangement both the ribbon 1 and correction tape 4 are shown in elevated position opposite the line of impact A. However, it will be understood that only the ribbon 1 or the correction tape will be selectively elevated opposite the line of impact A.

As may be seen from FIG. 2, the correction tape carrier 7 is designed so that it encloses the ribbon cassette 2 like a frame. It goes without saying that other arrangements are possible.

Due to the scissors-like overlap of the lower long edge of the ribbon 1 and the upper long edge of the correction tape 4, albeit in spaced planes, it is reliably prevented that ribbon 1 and correction tape 4 can get on top of each other.

The invention claimed is:

1. A typewriter comprising a platen, an inked ribbon and a correction tape supporting means for supporting said ribbon and tape and for providing selective movement of each said ribbon and tape from a respective lowered position to a respective elevated position, each said respective elevated position being between a printing line along said platen and a line of print impact perpendicular to a plane which is tangent to said platen and contains said printing line, wherein, said lowered and elevated positions of said ribbon are parallel to said printing line, said respective lowered position of said tape is at first inclined angle with respect to said printing line, the respective elevated position of said tape is at a second inclined angle with respect to said printing line which is greater than said first inclined angle, and said tape is not in said line of print impact when in said lowered position, and is in said line of print impact when in said respective elevated position, and wherein said support means includes means constraining movement of said tape and said ribbon such that said tape and ribbon at all times overlap at some point and a scissors-like relative motion is provided for all relative motion between said ribbon and tape, to prevent any one of said ribbon and tape from catching on the other.

2. The typewriter of claim 1, said support means comprising a frame for supporting said tape at said first and second inclined angles at said lowered and elevated positions, pivot means for supporting said frame and for pivoting said frame about an axis parallel to said line of print impact and below the printing line, and elevating means for moving said tape between the respective lowered and elevated positions, by pivoting said tape frame at a predetermined part of said tape frame about said pivot to present a length of said tape in said line of print impact when in said respective elevated position.

3. The typewriter of claim 2, wherein said ribbon is mounted in a ribbon cassette, and said fram has a U-shape adapted to embrace said ribbon cassette.

* * * * *